US008839915B2

(12) United States Patent
Vithani et al.

(10) Patent No.: US 8,839,915 B2
(45) Date of Patent: Sep. 23, 2014

(54) RAILWAY FREIGHT CAR HAND BRAKE SENSOR

(75) Inventors: Anand R. Vithani, Addison, IL (US); David C. Brabb, Chicago, IL (US)

(73) Assignee: Sharma & Associates, Inc., Countryside, IL (US)

( * ) Notice: Subject to any disclaimer, the term of this patent is extended or adjusted under 35 U.S.C. 154(b) by 2152 days.

(21) Appl. No.: 11/580,484

(22) Filed: Oct. 13, 2006

(65) Prior Publication Data

US 2007/0084676 A1 Apr. 19, 2007

Related U.S. Application Data

(60) Provisional application No. 60/727,900, filed on Oct. 18, 2005.

(51) Int. Cl.
*F16D 66/00* (2006.01)
*B61H 13/02* (2006.01)

(52) U.S. Cl.
CPC ..... *B61H 13/02* (2013.01)
USPC ..... 188/1.11 E; 92/5 R; 116/52

(58) Field of Classification Search
USPC ..... 188/1.11 R, 107, 1.11 E; 92/5 R
See application file for complete search history.

(56) References Cited

U.S. PATENT DOCUMENTS 3,854,417 A * 12/1974 MacDonnell et al. ..... 105/463.1
4,296,707 A * 10/1981 Kennedy ..... 116/58 A
4,368,793 A * 1/1983 Igarashi ..... 180/14.4
5,586,812 A * 12/1996 Kanjo et al. ..... 303/7
5,701,974 A * 12/1997 Kanjo et al. ..... 188/1.11 R
5,738,416 A * 4/1998 Kanjo et al. ..... 303/7
5,813,290 A * 9/1998 Takahashi et al. ..... 74/501.5 R
5,890,406 A * 4/1999 Thorn ..... 81/468
6,112,860 A * 9/2000 Shepherd et al. ..... 188/1.11 R
6,135,242 A * 10/2000 Hockley ..... 188/1.11 R
6,179,093 B1 * 1/2001 Daugherty, Jr. ..... 188/33
6,237,722 B1 * 5/2001 Hammond et al. ..... 188/1.11 R
6,364,069 B1 * 4/2002 Ring ..... 188/1.11 R
6,474,450 B1 * 11/2002 Ring et al. ..... 188/1.11 R
6,474,451 B1 * 11/2002 O'Brien, Jr. ..... 188/1.11 R
6,578,679 B2 * 6/2003 Hill et al. ..... 188/170
6,913,325 B2 * 7/2005 Michel et al. ..... 303/2
6,943,675 B2 * 9/2005 Petersen et al. ..... 340/453
7,093,361 B2 * 8/2006 Richard ..... 29/890.06
7,156,471 B2 * 1/2007 Sommerfeld ..... 303/2
7,437,988 B2 * 10/2008 Andersson et al. ..... 92/5 R
7,716,831 B2 * 5/2010 Richard ..... 29/890.09
2001/0018861 A1 * 9/2001 Glasson ..... 92/5 R
2003/0040885 A1 * 2/2003 Schoess et al. ..... 702/173

(Continued)

*Primary Examiner* — Robert A Siconolfi
*Assistant Examiner* — James Hsiao
(74) *Attorney, Agent, or Firm* — James Ray & Assoc

(57) ABSTRACT

In combination with a railway car hand brake, there is an apparatus for sensing the hand brake release comprising a housing and a mounting mechanism for attaching the housing to a cover of such hand brake. An actuating mechanism is disposed in the housing. A sleeve member is disposed on the actuating mechanism and includes a flange. A flexible connecting mechanism engages the sleeve member and a winding gear portion of the hand brake. A sensing mechanism is disposed in the housing and aligned with the actuating mechanism. A securement mechanism is disposed on the sensing mechanism and mounted on the cover of the hand brake. A compression member is disposed in the housing and engages the flange of the sleeve member, whereby an electrical or magnetic signal will be received from the actuating mechanism by the sensing mechanism.

11 Claims, 3 Drawing Sheets

(56) References Cited

U.S. PATENT DOCUMENTS

2003/0200818 A1* 10/2003 Adrian ..... 73/862.391
2004/0150259 A1* 8/2004 Michel et al. ..... 303/2
2005/0145444 A1* 7/2005 Petrak ..... 188/2 D

* cited by examiner

RAILWAY FREIGHT CAR HAND BRAKE SENSOR

CROSS-REFERENCE TO RELATED APPLICATION

The present invention is related to and claims priority from Provisional Patent Application Ser. No. 60/727,900 filed Oct. 18, 2005.

FIELD OF INVENTION

The present invention relates, in general, to a railroad freight car hand brake mechanism and, more particularly, this invention relates to a sensing apparatus for a railroad freight car hand brake to determine that a handbrake is in one of a released position or not.

BACKGROUND OF THE INVENTION

All railroad freight cars are required to have at least one hand brake attached thereto on at least one predetermined end of the freight car. Such railroad freight car hand brakes are quite well known in the prior art. For example, there are a number of railroad freight car hand brake manufacturers which include Ellcon-National and Cardwell Westinghouse.

In many cases, the hand brake is usually set and released manually by a person walking along the train consist, or more recently such hand brakes can be attended to from a remote location by a pneumatic or similar mechanism. Currently, a member of the train crew must physically examine and determine that each hand brake is fully released before attempting to move the car.

If, for example, one or more of the hand brakes is not fully released when the train is operated, the wheels of the respective cars whose brakes have not been fully released will not rotate freely as designed, causing unintentional friction between the wheels and the track. When the wheels are not turning they will develop undesirable flat spots. This will ultimately require relatively expensive maintenance and repair and/or replacement of the car wheels and track.

SUMMARY OF THE INVENTION

In combination with a railway freight car hand brake mechanism for engaging the brake with a railway car wheel, the present invention provides, an improvement comprising an apparatus for sensing the full release of such hand brake. The apparatus includes a housing member having each of a predetermined size, a predetermined shape, a first end and a second end. A mounting means is provided for rigidly attaching the housing member to the outer cover member of the hand brake. There is an actuating means concentrically disposed in the housing member for controlling the action of the apparatus. A sleeve member is concentrically disposed on the actuating means which has an end equipped with a flange portion and an opposed end. A flexible connecting means is engageable with the opposed end of the sleeve member and a winding gear portion of the hand brake. A sensing means is concentrically disposed in the housing member and laterally aligned with the actuating means. The sensing means has a connection with a remote signaling device. A securement means is concentrically disposed on the sensing means and is mounted in the housing member. The securement means has a first end and an opposed second end. The first end of the securement means has a flange portion disposed on the second end of the housing member. A compression member having a predetermined load rating and length is concentrically disposed in the housing member and engages with the flange portion of the sleeve member, whereby an electrical signal will be received from the actuating means by the sensing means. The sensing means will remotely signal to the train engineer that the hand brake is released, thus indicating that the railway freight car can now be operated.

OBJECTS OF THE INVENTION

It is, therefore, one of the primary objects of the present invention to provide an apparatus for remotely determining the brake status of a railcar hand brake to ensure that the hand brake is fully released before moving the rail car and causing undesirable damage to the wheels and the track.

Another object of the present invention is to provide an apparatus for remotely determining the hand brake status of a railcar which substantially minimizes the hazardous routine of train personnel having to walk between railcars to visually and manually inspect the hand brake status.

Still another object of the present invention is to provide an apparatus for remotely determining the hand brake status of a railcar which will significantly reduce maintenance costs for the railroads.

Yet another object of the present invention is to provide an apparatus for remotely determining the hand brake status of a railcar which can be retrofitted to existing railway car hand brakes.

A further object of the present invention is to provide an apparatus for remotely determining the hand brake status of a railcar which is relatively simple to operate.

An additional object of the present invention is to provide an apparatus for remotely determining the hand brake status of a railcar which will exhibit a relatively long life.

In addition to the various objects of the present invention that have been described with some degree of specificity above, various other objects and advantages of the invention will become more readily apparent to those persons who are skilled in the relevant art from the following more detailed description of the invention, particularly, when such description is taken in conjunction with both the attached drawing figures and the appended claims.

Figure 1:
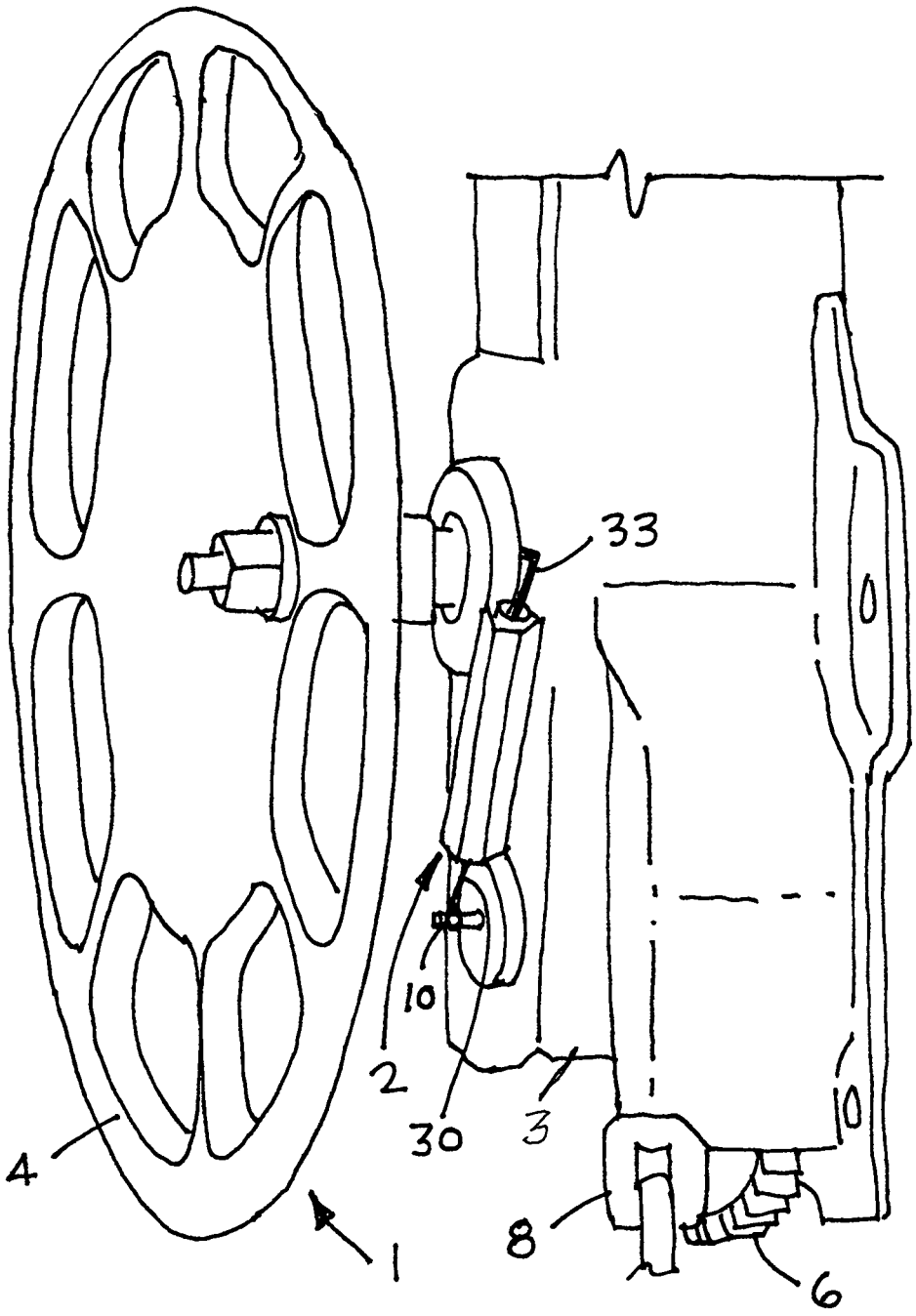
FIG. 1 is a perspective view of a presently preferred embodiment of the apparatus for a railway freight car hand brake mounted on a railcar hand brake assembly.

BRIEF DESCRIPTION OF A PRESENTLY PREFERRED AND VARIOUS ALTERNATIVE EMBODIMENTS OF THE PRESENT INVENTION

Prior to proceeding to a more detailed description of the instant invention, it should be noted that, for the sake of clarity and understanding, identical components which have identical functions have been designated with identical reference numerals throughout the several views illustrated in the drawing Figures.

Figure 2:
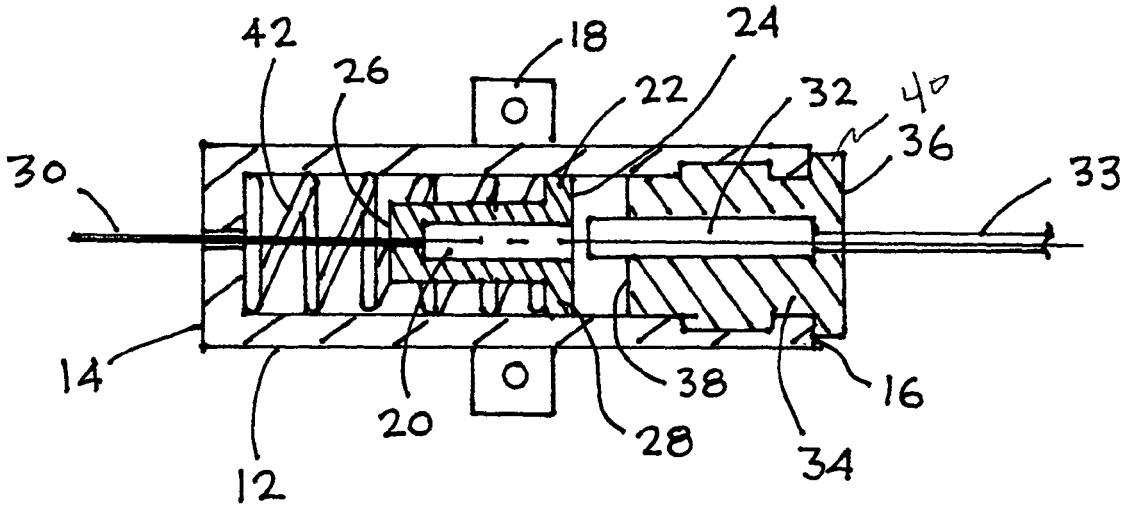
FIG. 2 is a cross-sectional view of the apparatus illustrated in FIG. 1 for a railway freight car hand brake.
Figure 3:
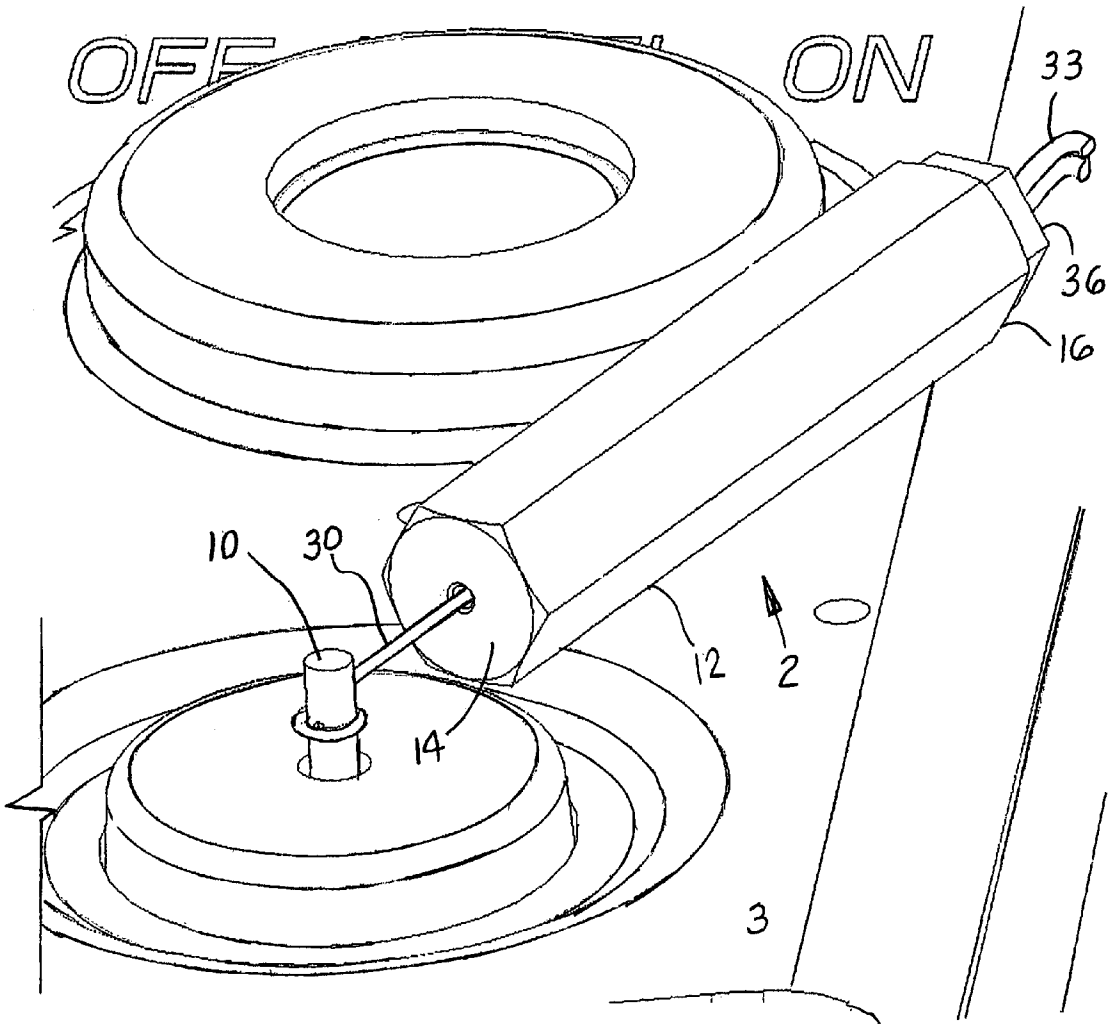
FIG. 3 is an enlarged view illustrating the attachment of the apparatus for sensing released status of a railway freight car hand brake to the housing of such hand brake.

Now refer, more particularly, to FIGS. 1-3 of the drawings. Illustrated therein, in combination with a railway freight car hand brake, generally designated 1, which is engageable with a railway car (not shown), is an apparatus, generally designated 2, for sensing the release of such hand brake 1.

The hand brake 1 can be set and released manually by a human being or remotely via a pneumatic or other similar power operated mechanism (not shown) by rotating one of a hand brake wheel 4 or a lever (not shown) or a separate means in the appropriate direction as required to actuate and rotate the winding gear 6 and the brake chain 8. An extension shaft 10 is attached to the winding gear 6, and rotates simultaneously with such winding gear 6.

Sensing apparatus 2 includes a housing member 12 having a predetermined size and shape. The housing member 12 has a first end 14 and a second end 16. A mounting means 18 is included on the housing member 12 for rigidly attaching the housing member 12 to the outer cover 3 of the hand brake assembly 1. An actuating means 20 is concentrically disposed in the housing member 12 for controlling an action of the sensing apparatus 2. Preferably, a preselected action of said actuating means 20 is selected from one of setting and releasing said hand brake 1.

A sleeve member 22 is concentrically disposed on the actuating means 20. Sleeve member 22 has a substantially open first end 24 and an opposed substantially closed second end 26. A flange portion 28 is disposed around the substantially open first end 24.

A flexible connecting means 30 is engageable with the opposed substantially closed second end 26 of sleeve member 22, and the winding gear extension shaft 10 of the hand brake 1. Such extension shaft 10 is connected to and rotatable with such winding gear portion 6 of the hand brake 1 on which such flexible connecting means 30 is engaged. A sensing means 32 is concentrically disposed in the housing member 12. Such sensing means 32 is further disposed substantially in lateral alignment with the actuating means 20. Additionally, the sensing means 32 has a connection with a remote signaling device 33.

A securement means 34 is concentrically disposed on the sensing means 32 and mounted in the housing member 12. The securement means 34 has a first end 36 and a second end 38. The first end 36 has a flange 40 disposed for engagement with the second end 16 of the housing member 12.

There is a compression member 42, having a predetermined load rating and length, concentrically disposed in the housing member 12. The compression member 42 is engageable with the flange portion 28 of the sleeve member 22. It is presently preferred that such compression member 42 is a coil spring member 42. Additionally, such coil spring type compression member 42 will exhibit a predetermined load rating.

The flexible connecting means 30 is wound around the extension shaft 10 as the hand brake wheel 4 is rotated and the hand brake 1 is set. In this position the sleeve member 22 and such actuating means 20 are pulled away from sensing means 32, whereby no electrical signal can be transmitted. This will indicate to the train operator that the hand brake 1 is not fully released. It should be noted that in the presently preferred embodiment of the invention such flexible connecting means 30 is a cable 30.

The flange portion 28 also makes contact with and depresses the compression member 42 to a loaded position. When the hand brake 1 is released, the flexible connecting means 30 is unwound from the extension shaft 10 and the tension on the flexible connecting means 30 is released, thus allowing the compression member 42 to return to the unloaded default position.

Now, the actuating means 20 is allowed to return to the contact position with the sensing means 32. An electrical or magnetic signal is then detected or received from the actuating means 20 by the sensing means 32. The sensing means 32 will send a signal through the remote signaling device 33 to the train operator that the hand brake 1 is released, indicating that the railway freight car can now be moved.

In the presently preferred embodiment of the invention the housing member 12 is an elongated member having a predetermined length. Also, in this presently preferred embodiment of the invention such predetermined shape of the housing member 12 is selected from one of generally cylindrical, rectangular, hexagonal and octagonal.

The mounting means 18 is secured to said outer cover 3 of said housing member of said hand brake 1 by one of welding, brazing, bolting or adhesive bonding. As shown in FIG. 2, in the presently preferred embodiment, the mounting means 18 is secured to such outer cover 3 of said housing member of the hand brake by bolting. It should be understood that it is presently preferred that the mounting means 18 engageable with such housing member 12 and an outer cover 3 of such hand brake 1 for rigidly attaching the housing member 12 to such outer cover 3 of the hand brake 1 is attached to an outer surface of such outer cover 3 of hand brake 1.

In today's modern hand brakes, it is possible for such hand brake 1 to be set either by hand and/or remotely by a power operated mechanism (not shown) by rotating a hand brake wheel 4 in an appropriate direction.

Although the invention has been shown in connection with a certain specific embodiment, it will be readily apparent to those skilled in the art that various changes in form and arrangement of parts and method may be made to suit requirements without departing from the spirit of the invention or the scope of the appended claims.

We claim:

1. In combination with a railway freight car hand brake engageable with a railway car, the improvement comprising an apparatus for sensing the full release of such hand brake, said apparatus including:

(a) a housing member having each of a predetermined size, a predetermined shape, a first end and a second end;

(b) a mounting means engageable with said housing member and an outer cover of said hand brake for rigidly attaching said housing member to an outer surface of said outer cover of said hand brake;

(c) an actuating means concentrically disposed in said housing member;

(d) a sleeve member concentrically disposed on said actuating means, said sleeve member having a first end and an opposed second end, said first end of said sleeve member having a flange portion;

(e) a flexible connecting means engaged with said opposed end of said sleeve member and a winding gear portion of such handbrake;

(f) a sensing means concentrically disposed in said housing member and laterally aligned with said actuating means, said sensing means having a connection with a remote signaling device;

(g) a securement means concentrically disposed on said sensing means and mounted in said housing, said securement means having a first end and an opposed end, said first end of said securement means having a flange portion disposed on said second end of said housing;

(h) a compression member having a length, said compression member concentrically disposed in said housing and engageable with said flange portion of said sleeve, whereby an electrical signal will be one of detected and received from said actuating means by said sensing means and said sensing means will remotely signal to a train engineer that such hand brake is released, thus indicating that such railway freight car is in an unbraked condition.

2. The combination, according to claim 1, wherein said housing member is elongated.

3. The combination, according to claim 2, wherein said predetermined shape of said housing member is selected from cylindrical, rectangular, hexagonal and octagonal.

4. The combination, according to claim 1, wherein said mounting means is secured to said outer cover of said housing member of said hand brake by one of welding, brazing, bolting and adhesive bonding.

5. The combination, according to claim 1, wherein said compression member is a coil spring.

6. The combination, according to claim 5, wherein said compression member has a predetermined load rating.

7. The combination, according to claim 1, wherein said flexible connecting means is a cable.

8. The combination, according to claim 1, wherein said hand brake is set one of by hand and remotely by power operated mechanism by rotating a hand brake wheel in an appropriate direction.

9. The combination, according to claim 8, wherein said hand brake further includes an extension shaft connected to and rotatable with said winding gear portion of said hand brake on which said flexible connecting means is engaged.

10. In a combination with a railway freight car hand brake, an improvement comprising an apparatus for sensing a release of said hand brake, said apparatus including:

(a) a housing member including a hollow interior, a closed end and an axially opposite open end, said closed end having an aperture formed through a thickness thereof;

(b) a pair of mounting tabs disposed on an exterior surface of said housing member, each of said pair of mounting tabs has an aperture formed through a thickness thereof so as to rigidly attach said housing member to an outer surface of an outer cover of said hand brake;

(c) a sleeve member mounted for a reciprocal linear movement within said hollow interior of said housing member, said sleeve having a hollow interior, a closed end, an axially opposite open end and a flange portion disposed on said open end of said sleeve member;

(d) an actuating member mounted within said hollow interior of said sleeve member;

(e) a flexible connecting member engaging with and connecting said closed end of said sleeve member directly with a an extension shaft of a winding gear portion of said hand brake, said flexible connecting member operable to move said sleeve member toward said closed end of said housing member during activation of said hand brake;

(f) a member disposed within said hollow interior of said housing member and including a body portion, a bore formed through said body portion and being disposed along a longitudinal axis of said housing member, a flange disposed external said housing member and closing said open end thereof, an aperture formed through a thickness of said flange of said member in an axial alignment with said bore;

(g) a sensing member disposed within said bore of said member and axially aligned with said actuating member, said sensing member having a connection with a remote signaling device, said connection passing through said aperture in said flange of said member;

(h) a compression member shaped to receive an exterior surface of said sleeve member therewithin, said compression member having a length thereof caged between an inner surface of said closed end of said housing member and a surface of said flange of said sleeve member, said compression member compressing, by way of a tension in said flexible connecting member and a movement of said sleeve member, toward said closed end of said housing member during said activation of said hand brake and extending toward said sensing member during said release of said hand brake and a release of said tension in said flexible connecting member so as to position said actuating member in a contact position with said sensing member, said contact position sufficient to generate an electric signal to a remote signaling device, said electric signal indicating said release of said hand brake.

11. The combination of claim 10, wherein said compression member is a coil spring.

* * * * *